US009045913B2

(12) United States Patent
Ishii et al.

(10) Patent No.: US 9,045,913 B2
(45) Date of Patent: Jun. 2, 2015

(54) BRACE MEMBER

(71) Applicants: JFE STEEL CORPORATION, Tokyo (JP); JFE CIVIL ENGINEERING & CONSTRUCTION CORPORATION, Tokyo (JP)

(72) Inventors: Takumi Ishii, Tokyo (JP); Hisaya Kamura, Tokyo (JP); Tomohiro Kinoshita, Tokyo (JP); Kazuaki Miyagawa, Tokyo (JP)

(73) Assignees: JFE STEEL CORPORATION, Tokyo (JP); JFE CIVIL ENGINEERING & CONSTRUCTION CORPORATION, Tokyo (JP)

( * ) Notice: Subject to any disclaimer, the term of this patent is extended or adjusted under 35 U.S.C. 154(b) by 0 days.

(21) Appl. No.: 14/359,412

(22) PCT Filed: Nov. 21, 2012

(86) PCT No.: PCT/JP2012/007483

§ 371 (c)(1),
(2) Date: May 20, 2014

(87) PCT Pub. No.: WO2013/076983

PCT Pub. Date: May 30, 2013

(65) Prior Publication Data

US 2014/0305048 A1 Oct. 16, 2014

(30) Foreign Application Priority Data

Nov. 25, 2011 (JP) ..... 2011-258073

(51) Int. Cl.
*E04H 9/02* (2006.01)

(52) U.S. Cl.
CPC . *E04H 9/021* (2013.01); *E04H 9/02* (2013.01)

(58) Field of Classification Search
CPC ..... E04H 9/028; E04H 9/021; E04H 9/14; E04H 9/027; E04H 9/029; E04H 9/02; E04H 9/024; E04H 9/025
USPC ..... 52/167.1, 167.3
See application file for complete search history.

(56) References Cited

U.S. PATENT DOCUMENTS

| | | | |
|---|---|---|---|
| 7,707,788 | B2 | 5/2010 | Bystricky et al. |
| 8,146,301 | B2 | 4/2012 | Bystricky et al. |

(Continued)

FOREIGN PATENT DOCUMENTS

| | | |
|---|---|---|
| JP | 08-312024 | 11/1996 |
| JP | 2010-522292 | 7/2010 |
| JP | 2011-202366 | 10/2011 |

OTHER PUBLICATIONS

International Search Report, PCT/JP2012/007483, Jan. 15, 2013.

*Primary Examiner* — Mark Wendell
(74) *Attorney, Agent, or Firm* — Young & Thompson

(57) ABSTRACT

A buckling stiffening brace member eliminates welding time. Readily available components such as a steel rod and a steel pipe can be used as an axial force member and a stiffening member. The axial force member and the stiffening member can be easily connected in a dry manner by threads. A thread for screwing with a joint is formed at an end of an axial force member. At an end of a stiffening pipe that does not have a retaining ring, a sleeve for suppressing neck bending of the axial force member is joined to the outer surface of the axial force member. The axial force member and the stiffening pipe are joined together with the retaining ring therebetween by inserting an end of the axial force member that does not have the sleeve into the inner peripheral surface of the retaining ring and joining it to the retaining ring.

8 Claims, 4 Drawing Sheets

(56) References Cited

U.S. PATENT DOCUMENTS

2005/0257490 A1* 11/2005 Pryor et al. ..... 52/736.3
2008/0229683 A1 9/2008 Bystricky et al.
2009/0133338 A1* 5/2009 Thompson et al. ..... 52/167.1
2010/0101160 A1* 4/2010 Bongiorno ..... 52/167.1
2011/0041425 A1 2/2011 Bystricky et al.
2011/0167638 A1 7/2011 Bystricky et al.

* cited by examiner

BRACE MEMBER

TECHNICAL FIELD

The present invention relates to a brace member having an axial force member that is installed in a building structure and that absorbs the seismic energy at the time of earthquake, and a stiffening pipe that supplements the stiffness of the axial force member.

BACKGROUND ART

Hitherto, with respect to a buckling stiffening brace member having an axial force member that is installed in a building structure and that absorbs the seismic energy at the time of earthquake, and a stiffening pipe that stiffens the axial force member, in order to increase the seismic energy absorbed by the axial force member, inventions for preventing total buckling of the axial force member and thereby achieving stable compressive and tensile plastic deformation have been made.

For example, Patent Literature 1 discloses a structural member that is formed by placing a steel pipe member outside a steel pipe member. The outer steel pipe member is formed by axially connecting several types of steel pipe members. End faces of the steel pipe members at axial ends are covered with end plates. Patent Literature 2 discloses a brace in which total buckling is prevented by filling a steel pipe member with mortar.

CITATION LIST

Patent Literature

Patent Literature 1: Japanese Unexamined Patent Application Publication No. 06-346510

Patent Literature 2: Japanese Unexamined Patent Application Publication No. 07-229204

SUMMARY OF INVENTION

Technical Problem

However, in the invention disclosed in Patent Literature 1, the outer steel pipe members are welded to each other, the end plates are also fixed by welding to the steel pipe members, and therefore, work man-hours for welding are required. When the axial cross-sectional area of an axial force member made of steel pipe members is relatively small, there is a problem that the processing cost per brace does not decrease.

In the invention disclosed in Patent Literature 2, since the steel pipe stiffening buckling is filled with mortar, there is a problem that the weight per brace increases.

The present invention has been made in view of the above, and it is an object of the present invention to provide such a buckling stiffening brace member that burdensome welding work can be eliminated, ready-made articles easily available from the market, such as a steel rod and a steel pipe, can be used as an axial force member and a stiffening member, and the axial force member and the stiffening member can be easily connected in a dry manner by threads.

Solution to Problem

In order to attain the above object, the present invention is characterized in that a brace member according to the present invention is configured as follows.

That is, a form of the brace member according to the present invention is characterized in that it includes an axial force member that forms a rod shape having a solid cross-section, that is installed between building structures by joints at both ends thereof, and that receives axial force, a stiffening pipe that forms a tubular shape, through which the axial force member is passed, and that supplements the stiffness of the axial force member, a retaining ring that is screwed to both an end of the stiffening pipe and the axial force member located inside it and that fixes the end of the stiffening pipe and the axial force member inside it to each other, and a sleeve that is interposed between an end of the stiffening pipe to which the retaining ring is not screwed and the axial force member located inside it, that is screwed on one of the outer periphery of the axial force member and the inner periphery of the stiffening pipe, and that forms a gap between itself and the other.

Another form of the brace member according to the present invention is characterized in that at an axial end of the retaining ring, an outward flange in contact with the end face of the stiffening pipe is formed integrally.

Still another form of the brace member according to the present invention is characterized in that the sleeve is screwed on the outer periphery of the axial force member, the gap is formed between the outer periphery of the sleeve and the stiffening pipe, and if the difference between the inner diameter of the stiffening pipe and the outer diameter of the sleeve, which is the gap, is denoted as d, and the axial length of the overlapping part between the stiffening pipe and the sleeve is denoted as L, $d/L \leq 0.85°$.

Advantageous Effects of Invention

Therefore, since a brace member to which the present invention is applied has the above-described configuration, the work man-hours for welding are not required, and therefore, the total manufacturing man-hours can be reduced, and the construction period can be shortened. As a result, an inexpensive brace can be provided according to the present invention.

Since the work of filling a stiffening pipe with mortar or the like is not required, the weight per brace can be made relatively small.

Since, at the time of manufacture of a brace, the axial force member and the stiffening pipe can be assembled in a dry manner, manufacture and management of a brace is easy.

DESCRIPTION OF EMBODIMENTS

Hereinafter, the embodiment of the present invention will be described in detail.

Figure 1:
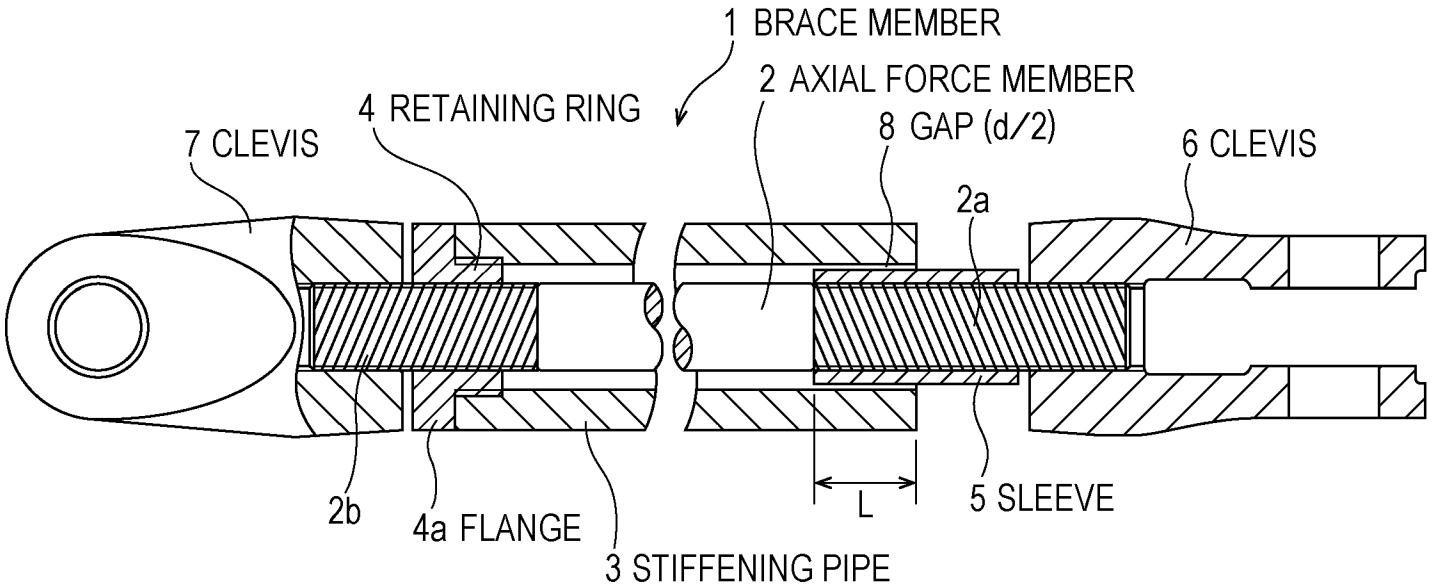
FIG. 1 is a partial sectional view of a brace member to which the present invention is applied, with a longitudinally central part omitted.
Figure 2:
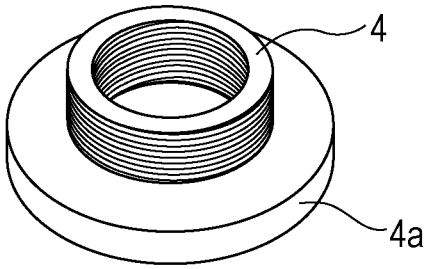
FIG. 2 is a perspective view of the retaining ring of FIG. 1.
Figure 3:
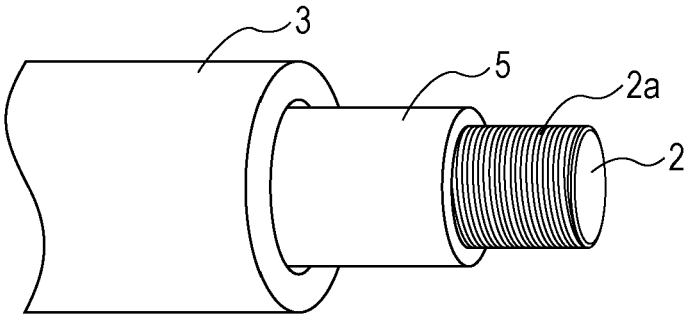
FIG. 3 is a perspective view showing the arrangement of a part of a male thread at one end of the axial force member of FIG. 1, a part of a sleeve on the outer periphery thereof, and a part of a stiffening pipe on the outer periphery thereof.
Figure 4:
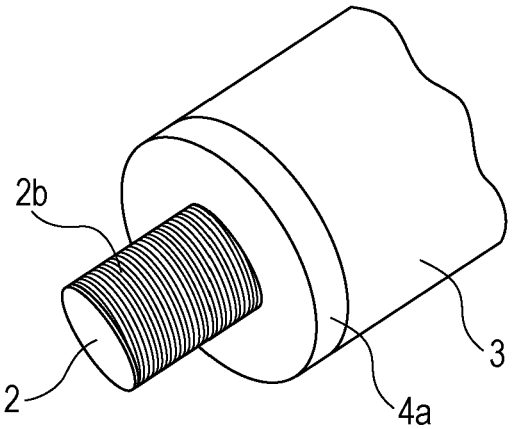
FIG. 4 is a perspective view showing the arrangement of a part of a male thread at one end of the axial force member of FIG. 1, a part of a flanged retaining ring on the outer periphery thereof, and a part of the stiffening pipe on the outer periphery of the male thread.

FIG. 1 is a diagram schematically showing a brace member 1 according to the embodiment of the present invention. In this diagram, in order to facilitate understanding of the structure of clevises, the clevises 6 and 7 at both left and right ends are rotated 90 degrees from each other about the central axis of an axial force member 2. The ratio of the thickness to the length in the axial direction of this type of brace member 1 is small, that is, it is thin. Therefore, if the structure of the brace member is precisely shown in a diagram, such a diagram is difficult to understand. So, in FIG. 1, the ratio of the thickness to the length in the axial direction is large. Therefore, the size relationship between parts is not limited to that shown.

In FIG. 1, the brace member 1 has an axial force member 2 that is made of a steel rod having a solid cross-section, a stiffening pipe 3 that is made of a steel pipe disposed coaxially so as to cover the outer surface of the axial force member 2, a retaining ring 4 that is screwed on the inner surface of one end of the stiffening pipe 3, and a sleeve 5 that is located inside the other end of the stiffening pipe 3 and that is screwed on the outer periphery of the axial force member 2.

On the outer periphery of the axial force member 2, a right-hand thread 2*a* is formed at the sleeve 5 side end of the steel rod, and a left-hand thread 2*b* is formed at the retaining ring 4 side end. The right-hand thread 2*a* and the left-hand thread 2*b* are of opposite hand to each other. As long as both the ends are threads of opposite hand, either may be a right-hand thread. To both ends of the axial force member 2, clevises 6 and 7 as joints for connecting this to a building structure are screwed.

A female thread (right-hand thread) is formed in the inner periphery of the retaining ring 4 side of the stiffening pipe 3, and no thread is formed in the inner periphery of the sleeve 5 side. The retaining ring 4 is screwed on both the inner surface of the end of the stiffening pipe 3 and the outer surface of the axial force member 2 inside it, and fixes the end of the stiffening pipe 3 and the axial force member 2 inside it to each other. On the outer periphery of the clevis 7 side end of the retaining ring 4, an outward flange 4*a* is provided integrally, and one surface of the flange 4*a* is in contact with one end face of the stiffening pipe 3.

The sleeve 5 is also made of a steel pipe, and is interposed between the end of the stiffening pipe 3 to which the retaining ring 4 is not screwed and the axial force member 2 inside it. A female thread is formed in the inner surface and is screwed on the outer periphery of the axial force member 2. The outer surface is merely a cylindrical surface and forms a gap 8 between itself and the stiffening pipe 3. If the difference between the inner diameter of the stiffening pipe 3 and the outer diameter of the sleeve 5, which is the gap 8, is denoted as d, and the axial length of the overlapping part between the stiffening pipe 3 and the sleeve 5 is denoted as L, $d/L \leq 0.85°$. The reason why the gap 8 is shown as "d/2" in FIG. 1 is that gaps 8 are formed between the sleeve 5 and the stiffening pipe 3, above and below the sleeve 5 in FIG. 1, and the sum of the upper and lower gaps, that is, the difference in diameter is "d", and therefore, when one of the gaps is indicated as shown, it is ½ of d.

Therefore, if the building structure is deformed at the time of earthquake and axial tension and compression force acts on the axial force member 2, since the axial force member 2 is stiffened by the stiffening pipe 3 and therefore total buckling hardly occurs in such a range, tension and compression plastic deformation occurs in a wide range (the same as a long range in the axial direction) of the axial force member 2, and seismic energy can be absorbed sufficiently.

The strength of the axial force member 2 is not particularly specified in this embodiment. Axial force members used as an aseismic brace generally have a yield strength of 100 $N/mm^2$, and therefore, in this embodiment, it is preferable to use a material having about the same strength.

The fact that the value obtained by dividing the difference d between the inner diameter of the stiffening pipe 3 and the outer diameter of the sleeve 5 by the length L of the overlapping part between the sleeve 5 and the stiffening pipe 3 is 0.85° (that is, 0.0149 rad) or less has the following technical meaning.

The difference between the inner diameter of the stiffening pipe 3 and the outer diameter of the sleeve 5 means the maximum value of the gap 8 between the stiffening pipe 3 and the sleeve 5. If for any reason bending occurs in the axial force member 2, the maximum angle of the bending is limited to such a range that the sleeve 5 can incline throughout this gap 8. If the above-mentioned gap is denoted as d, the length of the overlapping part between the sleeve 5 and the stiffening pipe 3 is denoted as L, and the maximum inclination angle is denoted as θ, $$d/L = \tan\theta \approx \theta.$$

That is, when this θ is large, bending of the axial force member 2 is likely to occur. The results of experiments conducted by the present inventors show that if θ exceeds 0.85° (that is, 0.0149 rad), neck bending of the axial force member 2 is likely to occur. Therefore, in the present invention, θ is preferably 0.85° (that is, 0.0149 rad) or less.

The axial force member 2, the retaining ring 4, the sleeve 5, and the stiffening pipe 3 of the brace member 1 can be assembled by threads, and the clevises 6 and 7 can also be attached by threads. The length adjustment can be easily changed by these threads, and therefore a construction error can also be eliminated. In particular, since the thread grooves at both ends of the axial force member 2 are of opposite hand as described above, the length adjustment is facilitated by the rotation of the axial force member 2. It is a matter of course that the above-mentioned adjustment may be performed by rotating another member.

In particular, the axial force member 2, the stiffening pipe 3, and the sleeve 5 can be processed simply by threading a steel rod and steel pipes that are commercially available, and the same applies to the retaining ring. In addition to the fact that the material is easily available and can be easily processed, the above-mentioned assembling and attachment are performed in a dry manner as described above, and therefore the management of the brace member 1 is facilitated.

Figure 5:
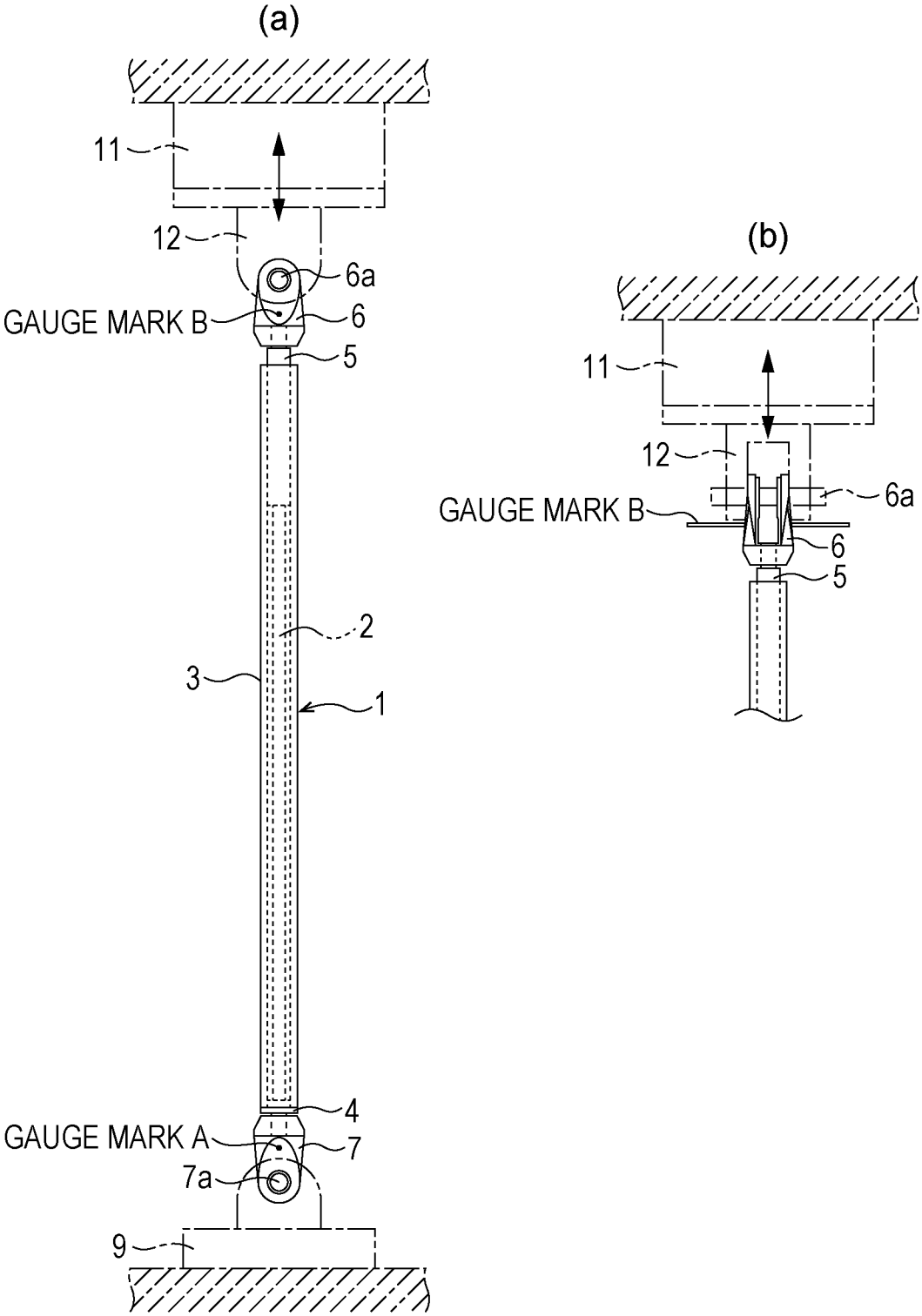
FIG. 5 is a front view showing the whole of the brace member shown in FIG. 1, and a state where this is set in a compressive and tensile testing machine.

FIG. 5 is a diagram of a test specimen that was subjected to a test for confirming the performance of the brace member 1 according to the embodiment shown in FIG. 1. This test specimen is the same as the brace member 1 of FIG. 1, and therefore, in FIG. 5, the same component names and reference signs as those in FIG. 1 will be used.

Here, the axial force member 2 is made of a steel rod having an outer diameter of 44.2 mm, a length of 2300 mm, and a strength of 600 $N/mm^2$ class, the stiffening pipe 3 is made of a steel pipe having an outer diameter of 105.0 mm, a thickness of 18.0 mm, a length of 2073 mm, and a strength of 400 $N/mm^2$ class, and the retaining ring 4 has a strength of 490 $N/mm^2$, has a steel pipe shape with a flange 4*a* having an outer diameter of 105.0 mm, and has a female thread of M48 formed in the inner surface thereof, and a male thread of M75 formed on the outer surface thereof. The sleeve pipe 5 has a steel pipe shape having a strength of 490 N/mm$^2$ class, and has an outer diameter of 62.6 mm, and a length of 478 mm. The length L of the part overlapping with the stiffening pipe 3 is 428 mm. A female thread of M48 is formed in the inner surface. The strength of the clevises 6 and 7 is 880 N/mm$^2$ class.

From the above, the inner diameter of the stiffening pipe 3 is (105.0−2×18.0)=69.0 mm, and therefore, the difference d between the inner diameter of the stiffening pipe 3 and the outer diameter of the sleeve pipe 5 is (69.0−62.6)=6.4 mm. Thus, d/L was (6.4/428)=0.0149 rad, that is, 0.85°.

The procedure for assembling the brace member 1 is as follows. First, one end of the axial force member 2 is inserted and screwed into the sleeve 5. Next, the retaining ring 4 is screwed to the inside of one end of the stiffening pipe 3. Then, the axial force member 2 is inserted into the side of the stiffening pipe 3 to which the retaining ring 4 is not attached, with the side to which the sleeve 5 is not attached first. The axial force member 2 is screwed into and passed through the retaining ring 4. Finally, the clevises 6 and 7 are screwed and fixed to both ends of the axial force member 2.

FIG. 5(*a*) also shows the situation of the test for confirming the performance of the brace member 1 according to the embodiment of the present invention. In FIG. 5(*a*), the clevises 6 and 7 fixed to both ends of the axial force member 2 are coupled to a force-receiving jig 9 fixed to the floor and to a force-applying jig 12 fixed to a testing machine 11 supported on the ceiling with clevis pins 6*a* and 7*a*, respectively. Therefore, the testing machine 11 moves up and down repeatedly in a plane, and thereby axial tension and compression force acts on the axial force member 2.

FIG. 5(*b*) is a diagram showing the upper half of FIG. 5(*a*) rotated 90 degrees about the central axis of the axial force member 2 in order to facilitate understanding of the coupling state between the clevis 6 at the top of the brace member 1 and the force-applying jig 12.

Figure 6:
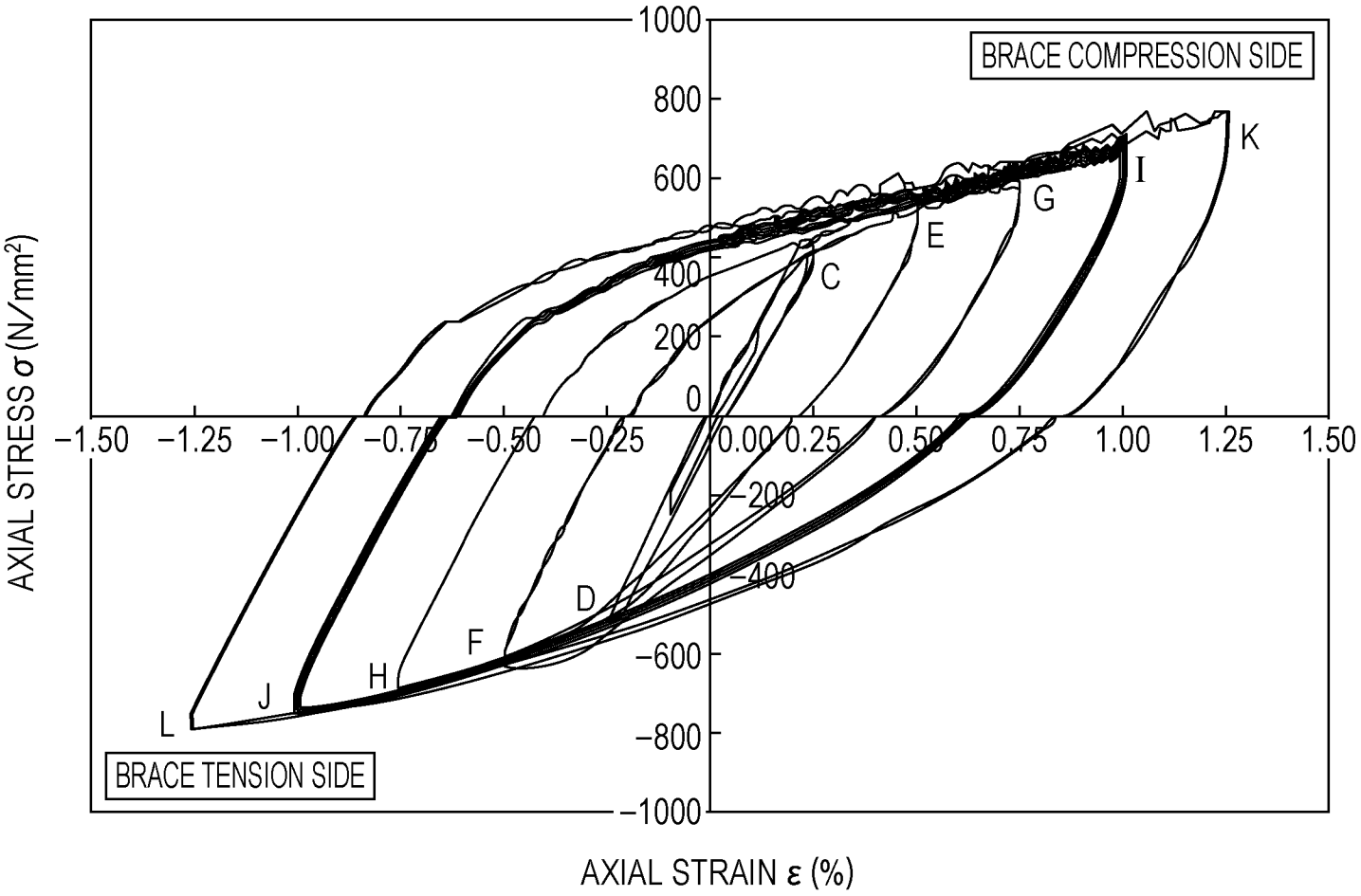
FIG. 6 is a stress-strain diagram showing the test results of FIG. 5.

FIG. 6 is a stress-strain diagram showing the results of a test for confirming the performance of the brace member 1 according to the embodiment of the present invention, in a case where a predetermined displacement is applied in the vertical direction in FIG. 5, and the displacement is changed one after another as will be described later. In FIG. 6, the vertical axis shows stress generated in the axial force member 2 (calculated value obtained by dividing the load added by the testing machine by the cross section of the axial force member 2), and the compression direction is shown in the positive direction (upward direction). The horizontal axis shows measurement value obtained by dividing the amount of elongation of the distance between gauge mark A and gauge mark B provided on the clevises 6 and 7 by the original length, and the direction in which the compression strain increases is shown in the positive direction (rightward direction).

FIG. 6 shows the results concerning the test specimen (that is, the brace member 1). First, the force-applying jig 12 is moved downward in FIG. 5 by the operation of the testing machine 11, and compressive force is applied to the axial force member 2. Elastic deformation starts from the origin. After compressive yielding, plastic deformation progresses while it is being work-hardened very slightly. When a predetermined displacement C is reached, the force-applying jig 12 of the testing machine 11 moves upward in FIG. 5, and tensile force is applied to the axial force member 2. When a predetermined displacement D is reached, it returns toward a predetermined displacement E.

The force-applying jig 12 of the testing machine 11 moves downward in FIG. 5, and therefore, compressive force is applied to the axial force member 2, and plastic deformation progresses. When the predetermined displacement E is reached, the force-applying jig 12 of the testing machine 11 moves upward in FIG. 5, and it returns toward a predetermined displacement F.

The force-applying jig 12 of the testing machine 11 moves repeatedly up and down, and therefore, the stress-strain diagram of the axial force member 2 shows hysteresis curves with a Bauschinger effect.

In this test, it withstood up to compressive/tensile deformation of 1.25% of the original length.

The above test results show that the number of times force is repeatedly applied to the axial force member 2 is large and sufficient energy is absorbed, and therefore the effect of the embodiment of the present invention is remarkable.

In the brace member 1 of FIG. 1 described above, the sleeve 5 is screwed on the outer periphery of the axial force member 2, and a gap 8 is formed between the sleeve 5 and the stiffening pipe 3. However, the gap 8 may be formed between the sleeve 5 and the axial force member 2. That is, a gap 8 can be formed between the sleeve 5 and the axial force member 2 by screwing the sleeve 5 on the inner surface of the stiffening pipe 3, and not forming thread grooves in the inner surface of the sleeve 5 and the outer surface part of the axial force member 2 covered by the sleeve 5. In this case, the length of the part of the sleeve 5 located inside the stiffening pipe 3 corresponds to the length L of FIG. 1. Therefore, when the clevis 6 side axial end face of the sleeve 5 is flush with the clevis 6 side axial end face of the stiffening pipe 3, the length L in FIG. 1 corresponds to the length of the sleeve 5. In such a case, the same effects as those of the embodiment described with reference to FIG. 1 can be obtained.

REFERENCE SIGNS LIST

1 brace member
2 axial force member
3 stiffening pipe
4 retaining ring
4*a* flange
5 sleeve
6, 7 joint (clevis)
8 gap
9 force-receiving jig
11 testing machine
12 force-applying jig

The invention claimed is:

1. A brace member comprising:

an axial force member having an outer surface extending from a first end to an opposite second end, the axial force member having a rod shape and having a solid cross-section, the axial force member having a stiffness;

first and second joints located respectively at the first and second ends of the axial force member, the first and second joints allowing installation of the axial force member between building structures, wherein with the axial force member installed, via the first and second joints, between building structures and the building structures are deformed, an axial tension and compression force acts on the axial force member;

a stiffening pipe having a tubular shape with an inner surface, a first end, and an opposite second end, the stiffening pipe disposed coaxially around the axial force member and supplementing the stiffness of the axial force member, the axial force member passing through the stiffening pipe;

a retaining ring having a first part with an outer surface and an inner surface, the outer surface of the first part of the retaining ring being screwed on the inner surface of the first end of the stiffening pipe, the inner surface of the first part of the retaining ring being screwed on the outer surface of the axial force member, the first part of the retaining ring being located interposed between, and in contact with, the inner surface of the first end of the stiffening pipe and the outer surface of the first end of the axial force member fixing the stiffening pipe to the axial force member;

a sleeve comprising a first part interposed between the stiffening pipe and the axial force member with i) an outer surface of the first part of the sleeve being located inside the second end of the stiffening pipe and ii) an inside surface of the sleeve being located outside of an outer periphery of the outside surface of the second end of the axial force member, wherein an inside surface of the sleeve is screwed on the outer periphery of the outside surface of the second end of the axial force member; and a gap located between the outer surface of the sleeve and the inside the second end of the stiffening pipe.

2. The brace member according to claim 1, wherein the retaining ring further comprises a second part with an outward flange integral with the first part of the retaining ring, the outward flange being in contact with an end face of the stiffening pipe and extending outward beyond an outermost diameter of the first part of the retaining ring.

3. The brace member according to claim 2, wherein a difference d between an inner diameter of the stiffening pipe and an outer diameter of the sleeve, which is the gap, and an axial length L of the first part of the sleeve interposed between the stiffening pipe and the axial force member satisfies the expression:

$$d/L \leq 0.0149 rad.$$

4. The brace member according to claim 1, wherein a difference d between an inner diameter of the stiffening pipe and an outer diameter of the sleeve, which is the gap, and an axial length L of the first part of the sleeve interposed between the stiffening pipe and the axial force member, satisfies the expression:

$$d/L \leq 0.0149 rad.$$

5. A brace member comprising:

an axial force member having an outer surface extending from a first end to an opposite second end, the axial force member having a rod shape and having a solid cross-section, the axial force member having a stiffness;

first and second joints located respectively at the first and second ends of the axial force member, the first and second joints allowing installation of the axial force member between building structures, wherein with the axial force member installed, via the first and second joints, between building structures and the building structures are deformed, an axial tension and compression force acts on the axial force member;

a stiffening pipe having a tubular shape with an inner surface, a first end, and an opposite second end, the stiffening pipe disposed coaxially around the axial force member and supplementing the stiffness of the axial force member, the axial force member passing through the stiffening pipe;

a retaining ring having a first part with an outer surface and an inner surface, the outer surface of the first part of the retaining ring being screwed on the inner surface of the first end of the stiffening pipe, the inner surface of the first part of the retaining ring being screwed on the outer surface of the axial force member, the first part of the retaining ring being located interposed between, and in contact with, the inner surface of the first end of the stiffening pipe and the outer surface of the first end of the axial force member fixing the stiffening pipe to the axial force member;

a sleeve comprising a first part interposed between the stiffening pipe and the axial force member with i) an outer surface of the first part of the sleeve being located inside the second end of the stiffening pipe and ii) an inside surface of the sleeve being located outside of an outer periphery of the outside surface of the second end of the axial force member, wherein the outer surface of the first part of the sleeve is screwed to the inside of the second end of the stiffening pipe; and a gap located between the outer periphery of the outside surface of the second end of the axial force member and the inside surface of the sleeve.

6. The brace member according to claim 5, wherein the retaining ring further comprises a second part with an outward flange integral with the first part of the retaining ring, the outward flange being in contact with an end face of the stiffening pipe and extending outward beyond an outermost diameter of the first part of the retaining ring.

7. The brace member according to claim 5, wherein a difference d between an inner diameter of the sleeve and an outer diameter of the axial force member, which is the gap, and an axial length L of the first part of the sleeve interposed between the stiffening pipe and the axial force member satisfies the expression $$d/L \leq 0.0149 rad.$$

8. The brace member according to claim 6, wherein a difference d between an inner diameter of the sleeve and an outer diameter of the axial force member, which is the gap, and an axial length L of the first part of the sleeve interposed between the stiffening pipe and the axial force member satisfies the expression:

$$d/L \leq 0.0149 rad.$$

* * * * *